US005701682A

United States Patent [19]

Chuang et al.

[11] Patent Number: 5,701,682

[45] Date of Patent: Dec. 30, 1997

[54] CAPILLARY DEWATERING METHOD AND APPARATUS

[75] Inventors: Strong C. Chuang, Chadds Ford, Pa.; Kenneth Kaufman, Mount Laurel, N.J.; Robert H. Schiesser, Warrington, Pa.

[73] Assignee: Kimberly-Clark Worldwide, Inc., Neenah, Wis.

[21] Appl. No.: 719,749

[22] Filed: Sep. 25, 1996

Related U.S. Application Data

[62] Division of Ser. No. 344,219, Nov. 23, 1994, Pat. No. 5,598,643.

[51] Int. Cl.[6] ..... D21F 5/00

[52] U.S. Cl. ..... 34/115; 34/125

[58] Field of Search ..... 34/114, 115, 116, 34/117, 119, 120, 122, 125; 162/111, 206, 207, 208

[56] References Cited

U.S. PATENT DOCUMENTS

| | | | |
|---|---|---|---|
| 1,549,338 | 8/1925 | Tompkins . | |
| 1,833,910 | 12/1931 | Parker . | |
| 1,834,852 | 12/1931 | Kutter . | |
| 2,083,817 | 6/1937 | Berry | 92/38 |
| 2,209,759 | 7/1940 | Berry | 92/49 |
| 3,262,840 | 7/1966 | Hervey | 162/205 |
| 3,327,866 | 6/1967 | Pall | 210/499 |
| 3,468,242 | 9/1969 | Schaffrath | 100/121 |
| 3,771,236 | 11/1973 | Candor et al. | 34/16 |
| 4,076,582 | 2/1978 | Burkhart | 162/272 |
| 4,309,246 | 1/1982 | Hulit et al. | 162/113 |
| 4,357,758 | 11/1982 | Lampinen | 34/9 |
| 4,551,894 | 11/1985 | Beucker | 29/130 |
| 4,556,450 | 12/1985 | Chuang et al. | 162/204 |
| 4,584,058 | 4/1986 | Lehtinen et al. | 162/199 |
| 5,242,644 | 9/1993 | Thompson et al. | 264/177 |

OTHER PUBLICATIONS

VA Strainer™ Brochure, published by Albany International Albany Engineering Systems.

Jones Polydisk Filter Operation Manual, No. BI-M67-01, published by E.D. Jones Corporation, Pittsfield, MA, 1968.

*Primary Examiner*—Henry A. Bennett
*Assistant Examiner*—Steve Gravini
*Attorney, Agent, or Firm*—Gregory E. Croft

[57] ABSTRACT

Disclosed is a method for reducing the moisture content of a paper web in a papermaking process from in the range of 10% to 32% dry to the range of 33% to 50% dry wherein the embryonic web is supported on a knuckled through drier fabric and lightly pressed between the knuckled through drier fabric and a capillary membrane of a capillary dewatering roll. The capillary membrane has capillary pores therethrough which have a substantially straight through, non-tortuous path with a pore aspect ratio of from about 2 to about 20. A vacuum is drawn within the capillary dewatering roll which is not greater than the negative capillary suction pressure of the capillary pores.

8 Claims, 10 Drawing Sheets

CAPILLARY DEWATERING METHOD AND APPARATUS

This application is a divisional of application Ser. No. 08/344,219 U.S. Pat. No. 5,598,643 entitled "CAPILLARY DEWATERING METHOD AND APPARATUS" and filed in the U.S. Patent and Trademark Office on Nov. 23, 1994. The entirety of this application is hereby incorporated by reference.

BACKGROUND OF THE INVENTION

1. Field of the Invention

This invention relates generally to the dewatering of paper webs in a papermaking process, and more particularly, to the use of capillary forces to remove water from unpressed wet webs without substantial overall compaction of the web during the papermaking process.

2. Brief Description of the Prior Art

U.S. Pat. No. 3,262,840 to Hervey relates to a method and system for removing liquids from fibrous articles such as paper and textiles using a porous polyamide body. The porous polyamide body is, for example, a resilient porous sintered nylon roll. In this method, a wet paper fiber web is passed through a series of pressure nips, each of which includes at least one porous nylon roll. Apparently, liquid is transferred from the wet paper fiber web into the porous nylon rolls by a combination of the pressure that is applied by the nip rolls, some degree of capillary action at the porous roll, and vacuum assistance. However, liquid transfer is substantially limited in this process because it must occur during the relatively short period of time in which the web passes between the nip and the opposed rolls. Hervey further discloses that the water taken in by the porous nylon roll is then either blown out of the pores by pressurizing a chamber within the roll or withdrawn from the pores by applying an external vacuum to the roll. This blowing out of the water from the pores also tends to clean the pores.

U.S. Pat. No. 4,556,450 to Chuang, et al., discloses a method and apparatus of removing liquid from webs through the use of capillary forces without compacting the web. The web passes over a peripheral segment of a rotating cylinder having a cover containing capillary-sized pores. The internal volume of the rotating cylinder is broken up into at least two and as many as six chambers, which are separated from each other by stationary parts and seals. At least one of the chambers has a vacuum induced therein to augment the capillary flow of water from the sheet. Another chamber includes a positive pressure to expel water from the pores outward of the cover after the skeet has been removed. Presumably, the pores are cleaned by this expulsion of water. All of the water taken from the sheet is held within or just under the pores and is expelled from the capillary cover at each revolution of the cylinder. A few cover materials are discussed, including a sinter-bonded Double Dutch Twill Weave as taught in U.S. Pat. No. 3,327,866 to Pall.

U.S. Pat. No. 4,357,758 to Lampinen teaches a method and apparatus for drying objects such as paper webs using a fine porous suction surface saturated with liquid and brought into hydraulic contact with a liquid that has been placed under reduced pressure with reference to the web being dried. The fine, porous liquid suction surface is located on the outside of a rotating drum and water is withdrawn from the drum apparently through the use of pumps which rotate with the drum. Lampinen does not seem to make any provision for cleaning the pores.

The prior art fails to teach the light knuckled pressing of the web against the capillary membrane to ensure hydraulic contact between the water contained in the web and the water in the pores of the capillary membrane without overall compaction of the web. This promotes greater and more rapid dewatering through the use of the capillary membrane. Further, lightly pressing the web against the capillary membrane with a knuckled surface is not taught in combination with a non-sectored capillary dewatering roll which is maintained at a single pressure throughout, that pressure approaching but not exceeding the effective capillary breakthrough pressure of the mean flow pore diameter of the capillary membrane. In addition, the prior art fails to disclose the washing and cleaning of the capillary membrane from the outside of the capillary dewatering roll to the inside thereby flushing any particulates trapped in the pores to the inside of the drum. This is possible because the drum is non-sectored and maintained at a single vacuum pressure, and further, because the capillary pores are substantially straight through, non-tortuous path pores.

SUMMARY OF THE INVENTION

It is therefore an object of the present invention to provide a method and apparatus for removing a portion of the liquid contained in a continuous wet porous web in a papermaking process without substantial overall compaction of the web using capillary forces.

It is a further object of the present invention to provide a capillary dewatering surface on a rotating capillary dewatering drum which can be cleaned through the use of external high pressure water sprays which clean the surface of the drum and flush particulate contaminants trapped within the capillary pores into the drum.

Yet another object of the present invention is to provide a method and apparatus for removing a portion of the liquid contained in a continuous wet porous web in a papermaking process where the hydraulic interface between the water contained in the continuous wet porous web and the water within the capillary pores of the capillary dewatering membrane is enhanced by lightly pressing the continuous wet porous web with an open, knuckled fabric against the capillary dewatering membrane.

Still a further object of the present invention is to provide a method and apparatus for removing the water withdrawn from a continuous wet porous web in a papermaking process from the capillary pores of the capillary membrane through the use of a non-sectored capillary dewatering roll maintained at a single vacuum pressure which approaches but does not exceed the effective capillary breakthrough pressure of the mean flow pore diameter of the capillary pores of the membrane.

Briefly stated, the foregoing and numerous other objects, features and advantages of the present invention will become readily apparent upon reading the detailed description, claims and drawings set forth herein. These objects, features and advantages are accomplished through the use of a capillary dewatering roll which includes a capillary dewatering membrane having a composite structure. The capillary dewatering membrane consists of at least two and as many as four layers. The top layer is the capillary surface itself against which the wet web is placed. The mean flow pore diameter of the pores of the capillary membrane should be about ten microns or less. Backing up this top capillary layer are one or more support layers. In addition to supporting and stabilizing the capillary membrane, these relatively open layers permit water to flow easily therethrough and into the inside of the perforated roll. This permits the capillary vacuum to be distributed uniformly under the top capillary membrane. The fact that succeeding layers have larger and larger openings permits any contaminant material that passes through or into the top capillary layer to continue to be flushed into the center of the dewatering roll.

The capillary dewatering roll is a non-sectored roll and is maintained under a constant vacuum which approaches the negative capillary suction pressure $C_p$ wherein:

$$C_p = \frac{2\sigma \cos\theta}{r}$$

where $\sigma$ is the water-air-solids interfacial tension, $\theta$ is the water-air-solids contact angle, and r is the radius of the capillary pore. If the contact angle in both the capillary pore and the capillaries of the sheet being dewatered are zero (perfectly wettable), then the radius of curvature of the water menisci in the air-water interface is about equal to r. This would be true within both the capillary membrane and within the sheet being dewatered. Once such an equilibrium state is reached, the dewatered sheet is moved away from the capillary medium. The vacuum source which is connected to the inside of the capillary dewatering roll simulates the capillary suction force, $C_p$, thereby promoting water flow through the capillary pores with the water on the underside of the capillary membrane being continually removed.

A cleaning shower is provided which washes the surface of the capillary dewatering roll between the point where the web leaves the surface of the capillary membrane and the point where the web is lightly pressed against the surface of the capillary membrane. The cleaning shower further serves to drive any particulates lodged in the capillary pores to the center of the roll where they are carried away with the water. The substantially straight-through, non-tortuous path pores facilitate this outside-in cleaning approach.

The capillary dewatering roll of the present invention may be used in a variety of papermaking process variations to improve the energy efficiency of the process. One such process is to deliver a furnish from a head box to a forming fabric to form an embryonic paper web. The embryonic paper web is then vacuum dewatered while supported on the forming fabric such that the web is in the range of from about 6% to about 32% dry. Multiple vacuum boxes will likely be necessary to achieve a dryness of 32%. The web is then vacuum transferred from the forming fabric to the open, knuckled transfer fabric and while supported on such transfer fabric, the web is lightly pressed against the capillary membrane surface of the capillary dewatering roll of the present invention. Alternatively, part or all of the vacuum dewatering could be done while the web is on the transfer fabric. The web is dewatered to the range of from about 33% to about 43% dry by the capillary dewatering roll. Additional drying can be accomplished by placing multiple capillary dewatering rolls in series. Drying of the web can then be completed by a variety of means including use of a through dryer, a Yankee dryer, a high temperature, gas fired surface dryer, steam heated can dryers, etc.

DETAILED DESCRIPTION OF THE PREFERRED EMBODIMENTS

Figure 1:
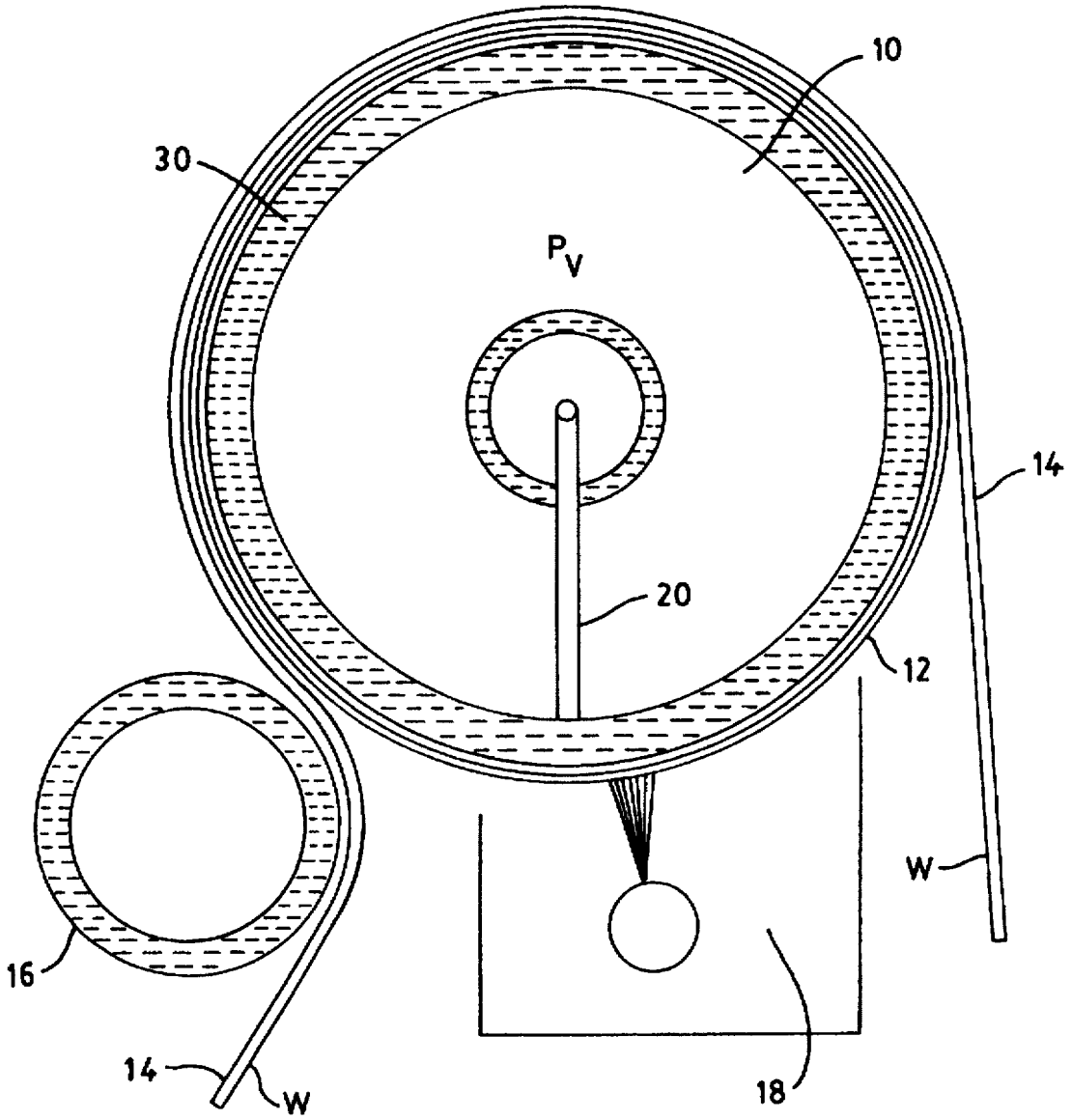
FIG. 1 is a diagrammatical depiction of a portion of a capillary dewatering system that is constructed according to a preferred embodiment of the invention.

Turning first to FIG. 1, there is shown the capillary dewatering drum 10 of the present invention having a capillary membrane composite 12 there about. A wet web W supported on an open, knuckled carrier fabric 14 is contacted against the capillary membrane composite 12 of the rotating capillary dewatering drum 10. A nip roll 16 lightly presses the web W against the capillary membrane composite 12 such that the web W is lightly compacted in the areas of the knuckles of the open, knuckled carrier fabric 14. "Lightly pressing," as defined herein, is pressing at a lineal force within the range of from less than one (by almost counterbalancing the weight of the nip roll) to about 150 pli (pounds of force per lineal inch). Most preferably, nip roll 16 presses the web W against the capillary membrane composite 12 at a lineal force that is substantially within the range of 20–50 pli. The purpose of the light knuckled pressing of the web against the capillary membrane is to ensure hydraulic contact between the water contained in the web and the water in the pores of the capillary membrane without overall compaction of the web. This promotes greater and more rapid dewatering through the use of the capillary membrane.

The invention could be operative at higher lineal pressures, perhaps as high as 400 pli, although unwanted compaction of the web could occur at such pressures.

Figure 2:
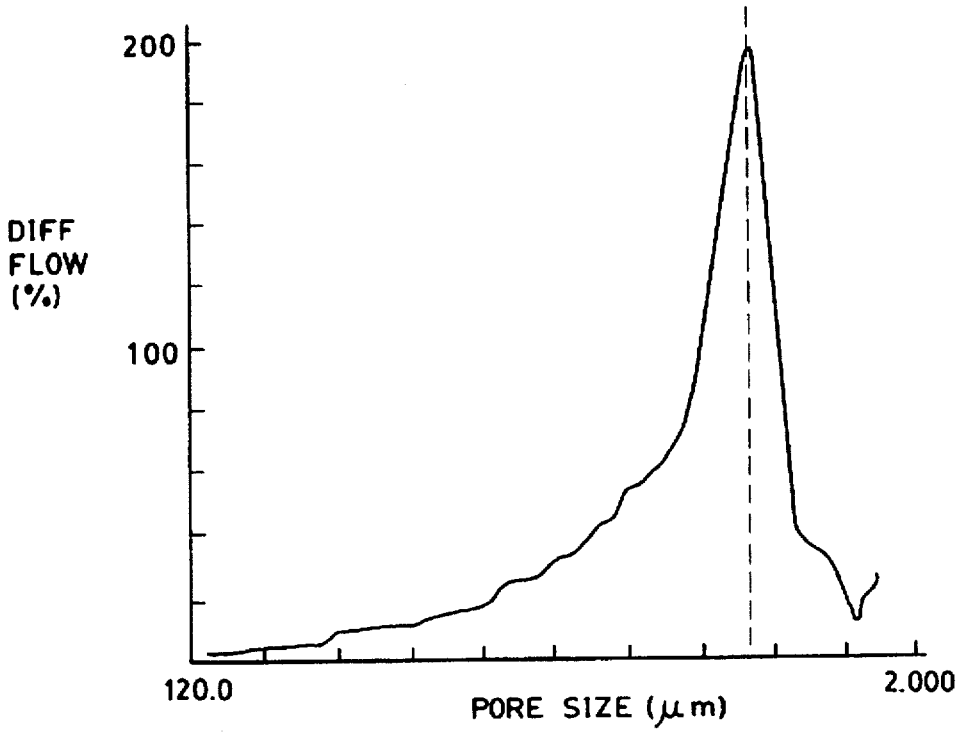
FIG. 2 is a Coulter Porometer pore-sized distribution curve of a hand sheet of Cottonelle® brand tissue as manufactured by Scott Paper Company at 10 lbs. per ream basis weight.
Figure 3A:
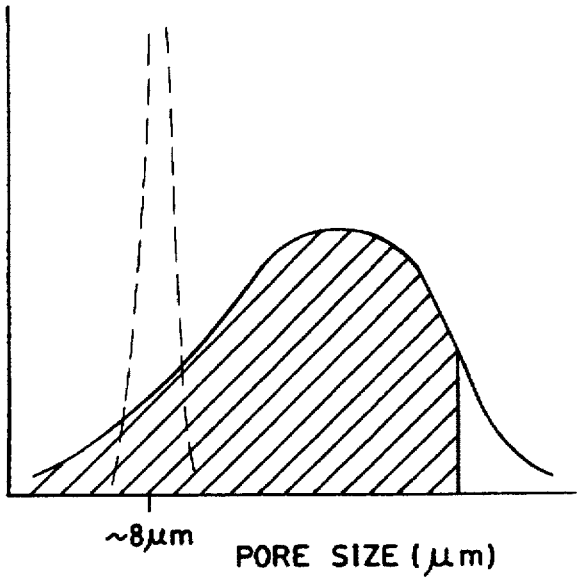
FIGS. 3A, 3B and 3C are graphical depictions of the controlled capillary dewatering process according to a preferred embodiment of the invention.
Figure 3B:
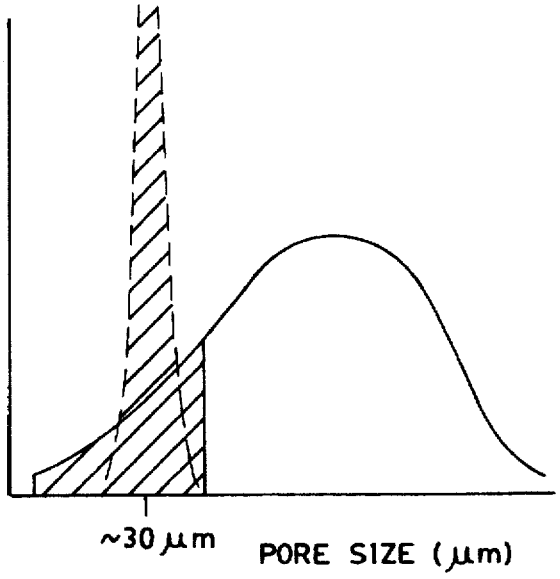
Figure 3C:
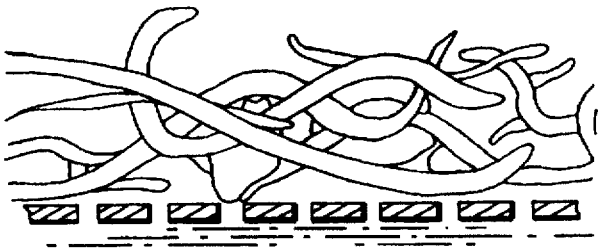

The web is not subjected to overall compaction but is lightly compacted in discrete locations where the web is contacted by the knuckles of the carrier fabric 14. Web W, while supported on the carrier fabric 14, is transported about a peripheral segment of the rotating capillary dewatering drum 10. After traveling about a peripheral segment of the capillary dewatering drum 10, the web W is removed from contact with the capillary membrane composite 12 while still supported on transfer fabric 14. There is a cleaning shower 18 which sprays water against the surface of the capillary membrane 12. The cleaning shower 18 washes the outside of the membrane 12 and further, drives through the capillary pores of the membrane 12 any particulates lodged therein such that the particulates are carried through the membrane composite 12 into the center of the drum 10. Water is removed from the center of the capillary dewatering drum 10 by means of a siphon 20. In operation, the capillary dewatering drum is subjected to an internal negative pressure. In other words, a vacuum is drawn on the inside of the drum 10 by a vacuum source which approaches the effective capillary breakthrough pressure of the mean flow pore diameter of the pores of the capillary membrane 12. The effective capillary breakthrough pressure is the pressure (vacuum) level where the air flow through the wet capillary membrane does not exceed 10% of the air flow through a dry membrane at the same pressure (vacuum). The capillary roll 10 is generally operated at a pressure (vacuum) where the air flow does not exceed 3% to 5% of the air flow through a dry membrane at the same pressure (vacuum) level, and can be operated with less of a vacuum level. FIG. 2 is a Coulter Porometer pore-sized distribution curve of a hand sheet of Cottonelle® brand tissue as manufactured by Scott Paper Company at 10 lbs. per ream basis weight. The curve shows that the maximum frequency distribution occurs at a pore diameter of about 30 microns. The mean flow pore size diameter is about 36 microns. This indicates that the majority of the free water contained in such a wet hand sheet is in the 30 micron or larger pore size range. This is conceptually represented in the graph of FIG. 3*a* which shows a schematic pore size distribution curve. The shaded area underneath this pore size distribution curve represents the amount of free water trapped within such pores. The controlled capillary dewatering concept under the present invention is basically to remove such free water by contacting the wet sheet with a dry capillary medium which has a smaller capillary pore size, for example, a capillary medium having a capillary pore size distribution peak at 8 microns. The schematic pore size distribution curve for the capillary medium is depicted as a dotted line in FIG. 3*a*. If this 8 micron capillary medium has enough pore volume, it will absorb from the larger pores within the sheet until an equilibrium state is reached. At such an equilibrium state, no more free water will remain in the sheet in pores 8 microns or larger in diameter. In this state, the water within the 8 micron pore size capillary medium and part of the residual water within the sheet are in a continuum phase. Within this continuum phase, there is a negative capillary suction pressure, $C_p$, wherein:

$$C_p = \frac{2\sigma \cos\theta}{r}$$

As mentioned above, if the contact angle in both the capillary and the sheet are zero, then the radius of curvature of water menisci in the air-water interface is about equal to r. Therefore, the smaller the radius r, the greater the quantity of water that will be absorbed from the sheet into the capillary medium, provided that the capillary medium has enough volume to hold the water being absorbed, or provided that a means is provided to remove the water from the capillary medium as it is absorbing water from the sheet.

Figure 4:
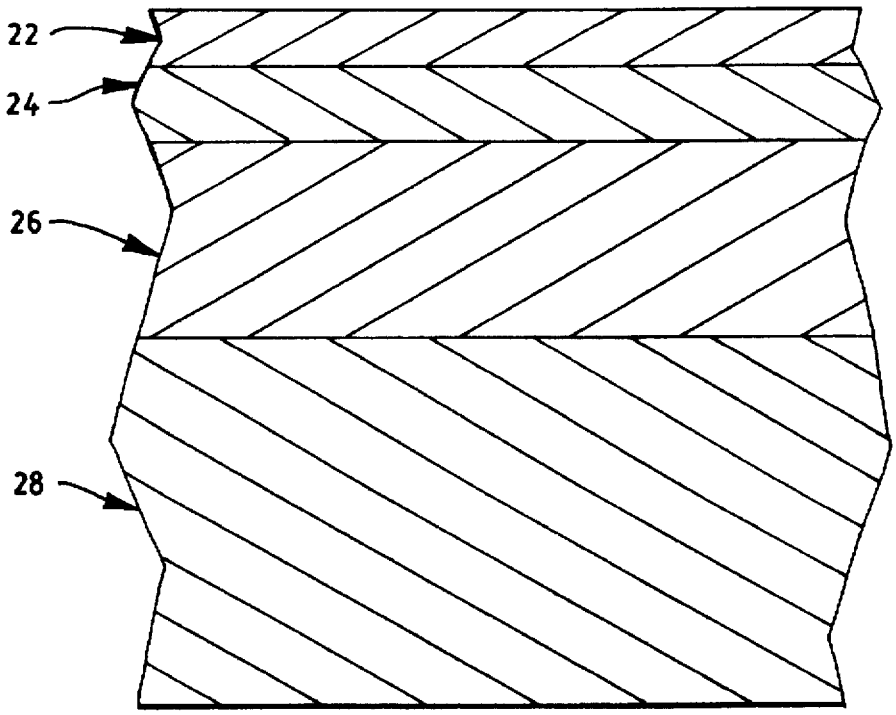
FIG. 4 is a fragmentary cross-sectional depiction of a capillary dewatering composite structure according to a preferred embodiment of the invention.

Looking at FIG. 4, there is shown the representational cross sectional view taken on lines 4—4 FIG. 1. From such cross section it can be seen that the capillary dewatering membrane 12 is actually a composite structure consisting of at least two and preferably as many as four layers. The top layer is the capillary surface 22 against which the wet web W is placed. The mean flow pore diameter (as measured by a Coulter Porometer as manufactured by Coulter Electronics, Inc. of Hialeah, Fla.) should be less than about 10 microns to induce high enough capillary vacuum levels to facilitate good dewatering. The smaller the capillary pore diameter, the higher the levels of dewatering, and the dryer the sheet as it departs from the capillary surface 22. Backing up the capillary surface layer 22 are support layers 24, 26 and 28. These support layers 24, 26, 28 and capillary membrane surface 22 are wrapped about the outside of a perforated vacuum roll 30. In addition to supporting and stabilizing the capillary surface membrane 22, these relatively open layers 24, 26, 28 permit water to easily flow therethrough to the inside of the perforated vacuum roll 30, thereby permitting the capillary vacuum to be distributed uniformly throughout the capillary membrane 22. The fact that the succeeding layers 24, 26, 28 open up, each internally succeeding layer having larger pore size openings than the previous layer, permits any contaminant material that passes through the top capillary layer to continue to be flushed into the roll center and out.

The layers 22, 24, 26, 28 are formed into a composite through combinations of gluing (plastics) or sinter-bonding (metals). One example (see Example A below) of an acceptable composite membrane structure for use with the present invention would be a Double Dutch Twill Woven mesh membrane (as can be obtained from Tetko Inc. of Briarcliff Manor, N.Y.) sinter-bonded to three successively more coarse supporting layers. A second example (see Example B below) would be a Nuclepore nucleation track membrane (as manufactured by Nuclepore Corporation of Pleasanton, Calif.) which is glued to a polyester nonwoven fabric which is, in turn, glued to a polyester woven mesh fabric.

The composite capillary membrane 12 is flexible enough to be wrapped around a perforated cylinder 30 which may have a diameter in the range of from 2 feet to 12 feet or more. Seams may be glued, butted, clamped, overlapped and/or welded. Trials have shown that as long as the seam in either the machine direction or the cross machine direction is less than about ⅛ of an inch wide, and as long as the dewatering time is 0.15 sec. or longer, no wet stripe is seen in the paper as it comes off the capillary dewatering roll 10. It appears that there is enough diffusion through the sheet to facilitate dewatering. Seams wider than about ⅛ inch may tend to show wet marks. Similarly, contaminated or clogged spots of about ¼ of an inch in diameter or less will not leave wet marks in the web.

EXAMPLE A - Sheet Dewatering

| | |
|---|---|
| Backing Fabric #1 (24) weave | 150 × 150 mesh, ss square |
| Baking Fabric #2 (26) weave | 60 × 60 mesh, ss square |
| Baking Fabric #3 (28) weave | 30 × 30 mesh, ss square |
| Cap. Membrane Surface (22) | Double Dutch Twill woven |
| mesh Type | Woven ss mesh; |
| simple path | |
| Mesh Count | 325 × 2300 |
| Equivalent Pore Length | ~110 μm |
| Coulter MFP Size | 9.19 μm |
| l/d | 12.0 |
| Air Permeability (ΔP-0.5" $H_2O$) | 5–10 cfm/ft.$^2$ |
| Furnish | 65% Pine/35% Eucalyptus |
| Basis Weight | 14 lb./2880 ft.$^2$ |
| Line Speed | 500 fpm |
| Residence Time | 0.46 sec. |
| Nip Roll Loading | 27 lbs/linear inch |
| Capillary Roll Vacuum ("$H_2O$) | 111 |
| Pre-Capillary Drum Dryness | 24.9% |
| Post Capillary Drum Dryness | 38.2% |

EXAMPLE B - Sheet Dewatering

-continued

| | |
|---|---|
| Backing Fabric #1 (24) | Polyester nonwoven |
| Baking Fabric #2 (26) #5135 | Polyester Mesh - Albany (30 × 36 square weave) |
| Cap. Membrane Surface (22) | Nuclepore 5.0 μm |
| Type | Nucleation Track |
| Equivalent Pore Length | 10 μm |
| Coulter MFP Size | 5.35 μm |
| l/d | 1.9 |
| Air Permeability (ΔP-0.5" $H_2O$) | 3.5 cfm/ft.$^2$ |
| Furnish | 70% NSWK/30% Eucalyptus |
| Basis Weight | 14 lb./2880 ft.$^2$ |
| Line Speed | 500 fpm |
| Residence Time | 0.46 sec. |

| | $B_1$ | $B_2$ |
|---|---|---|
| Nip Roll Loading (pli) | 45 | 0 |
| Capillary Roll Vacuuin ("$H_2O$) | 134 | 134 |
| Pre-Capillary Drum Dryness | 23.1% | 23.3% |
| Post Capillary Drum Dryness | 39.7% | 32.7% |

With the capillary dewatering roll 10 of the present invention, a thin capillary membrane 22 is used containing fine capillary pores but not much volume or thickness. The longer the pore, the longer the time for the water to be absorbed from the sheet because of viscous drag forces. Further, with longer fine capillary pores, there is a greater chance for clogging of the pores by fine contaminants or coating build-up and the pores are more difficult to clean. Because the capillary membrane surface 22 is relatively thin and therefore, does not have the volumetric capacity to hold the volume of water to be absorbed from the sheet, a vacuum source is connected to the underside of the capillary membrane to simulate the capillary suction force, $C_p$, and promote water flow through the capillary pores. This allows the water which is removed from the sheet to pass completely through the capillary membrane surface 22 and the support layers 24, 26, 28 such that the water can be continually removed from the inside of drum 30. Because the water is continually removed from the capillary membrane surface 22, additional volume for more absorption by capillary membrane surface 22 is continually created. The vacuum level within the vacuum drum 30 should be as close to $C_p$ as possible to promote the maximum sheet dewatering. However, if the vacuum is greater than $C_p$, the capillary water seal will be broken and air will start to leak through. If this happens to any great extent, vacuum energy is wasted and the capillary dewatering effect is compromised.

The smaller the capillary pore diameter, the higher the levels of dewatering, and the dryer the sheet is as it comes off of the capillary surface. However, the smaller the pore diameter, the more difficult to keep the pores from being contaminated or clogged. Thin capillary membranes with mean flow pore diameters of about 5 microns have performed well in tests. (Mean flow pore diameter refers to the equivalent pore diameters of pores of non-circular cross-section.) Such capillary pore size membranes have produced high sheet dryness levels and tended to stay clean. Pore sizes from 0.8 to 10 microns have been run with vacuum levels from 3 inches of $H_g$ to about 15 inches of $H_g$. Preferred pore diameter is in the range of from about 2 to about 10 microns.

Figure 5A:
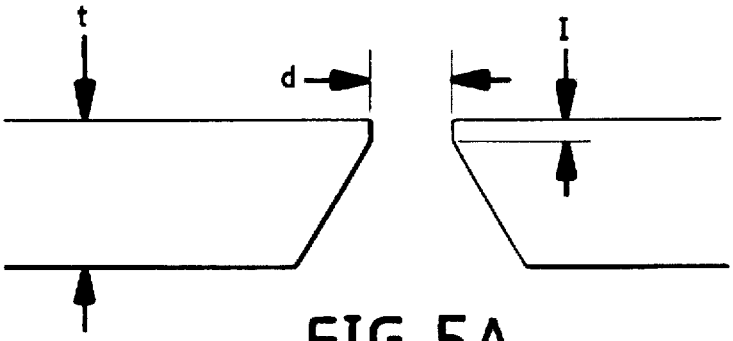
FIGS. 5A and 5B depict ideal and realistic pore configurations.
Figure 5B:
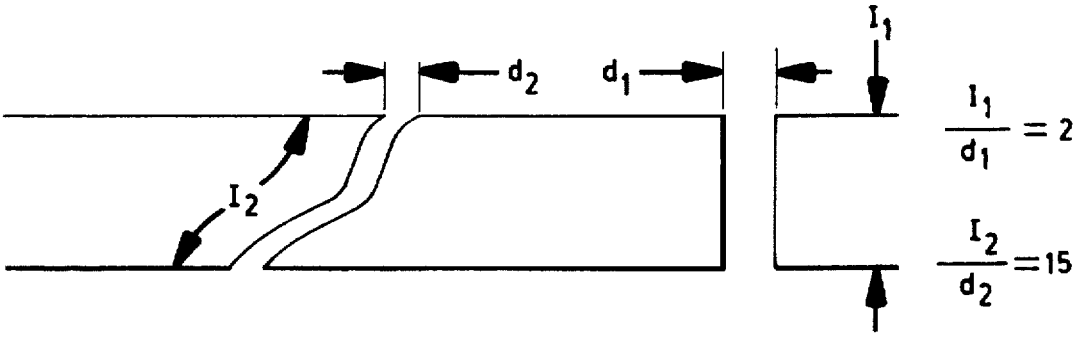

Preferably, the capillary pore should be as short as possible and then open up quickly downstream above the minimum pore diameter (see FIG. 5A). In this way, the capillary forces can be generated with reduced flow resistance. In addition, contamination of the pore is minimized. Any particles passing through the minimum pore diameter would not tend to become trapped and thus this type of pore design facilitates an outside to in cleaning of the capillary dewatering roll 10. In practice, the preferred design is to keep the pore as short as possible with respect to its diameter. The ratio of the actual, equivalent capillary pore path length, l, to the equivalent pore diameter, d, should be small (see FIG. 5B). The pore aspect ratio (l/d) should be in the range of from about 2 to about 20. Preferably, pore aspect ratios should be less than 15. Straight through pores are preferred. The more tortuous the path, the harder to keep the pore open and clean. Labyrinth type structures (e.g., foam types, sintered metals, ceramics) are the most difficult to keep clean and are not preferred.

The permeability of the capillary membrane 22 is also of importance since it affects the volume of water which can be removed in a given period of time. The permeability is related to pore size, pore aspect ratio, and pore density and can be characterized by the Frazier Number (air flow volume per unit area of surface at 0.5" $H_2O$ Δp). Relatively high permeabilities are desired. Thus, Frazier Numbers above 3 are preferred. But lower permeability membranes (Frazier Number of approximately 0.8) have been run in an acceptable manner.

Figure 6:
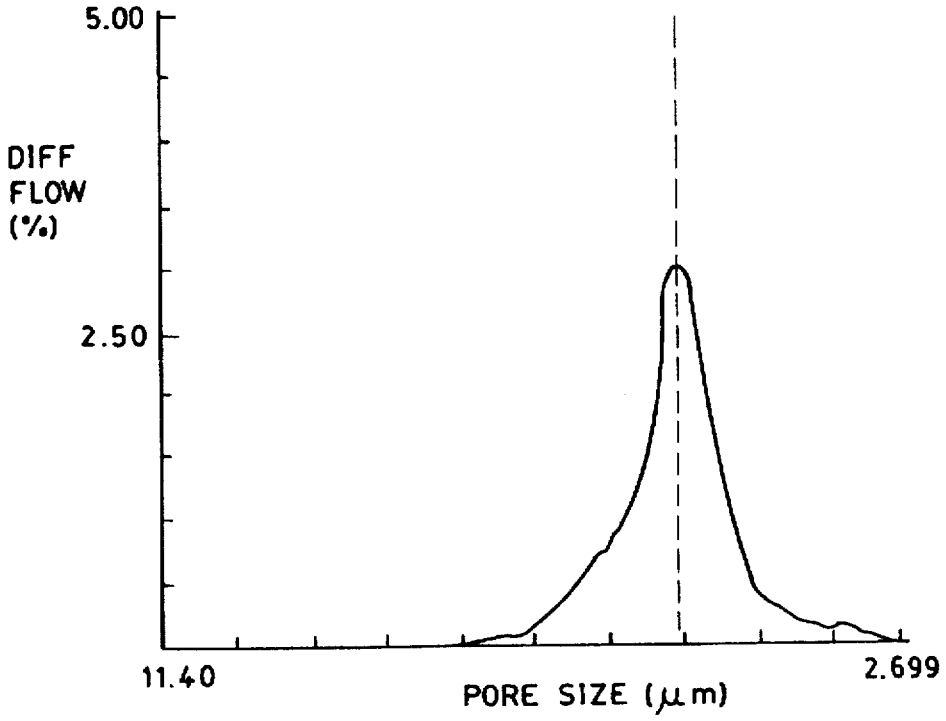
FIG. 6 is a graphical depiction of a Colter Porometer differential flow distribution for a Nuclepore 5 micrometer capillary membrane according to the invention.

As mentioned previously, straight through, non-tortuous path capillary pores are preferred. Direct through capillary pores as produced by nucleation track technique (e.g., Nuclepore or Poretics) serve well as the surface membrane 22 of the present invention to dewater wet webs. Such capillary pores have an excellent pore aspect ratio (l/d) making them good for keeping clean as well as for dewatering. They also have a small pore size range as measured by the Coulter Porometer. In other words, the pore size distribution for capillary pores produced by nucleation track technique is relatively small. This is shown in the graph of FIG. 6 which plots pore size distribution of Nuclepore 5 micron pore structure against differential flow percentage. As mentioned above, a nucleation track membrane can be obtained from Nuclepore Corporation. The disadvantage of membranes 22 manufactured by nucleation track technique is that the membranes are somewhat fragile. However, these types of membranes are effective in dewatering unpressed wet sheets as the outside or capillary layer 22 of the composite membrane 12.

Capillary membranes 22 have also been run successfully using polyester woven mesh fabrics such as PeCap 7-5/2 (see Example C) which is available from Tetko Inc. of Briarcliff Manor, N.Y. In addition, the steel Double Dutch Twill woven wire meshes as described in U.S. Pat. No. 3,327,866 to Pall, et al., have been used as an acceptable capillary layer in the process of the present invention for dewatering wet webs. As noted in the Pall, et al. patent, these woven wire meshes may be calendared and sinter-bonded to lock the openings in place and smooth out the surface. Other membranes may also be acceptable as long as they fall within the ranges for the preferred diameter, pore aspect ratio, and permeability.

EXAMPLE C - Sheet Dewatering

| | |
|---|---|
| Backing Fabric #1 (24) #5135 | Polyester Mesh - Albany (30 × 36 square weave) |
| Cap. Membrane Surface (22) | PeCap 7-5/2 |
| Type fabric | Polyester monofilament |
| Equivalent Pore Length | 65 μm |
| Coulter MFP Size | 6.26 μm |
| l/d | 10.4 |

-continued

| EXAMPLE C - Sheet Dewatering | |
|---|---|
| Air Permeability (ΔP-0.5" $H_2O$) | 0.9 cfm/ft.$^2$ |
| Furnish | 60% Pine/40% Eucalyptus |
| Basis weight | 14 lb./2880 ft.$^2$ |
| Line Speed | 500 fpm |
| Residence Time | 0.46 sec. |
| Nip Roll Loading (pli) | 34 |
| Capillary Roll Vacuum ("$H_2O$) | 186 |
| Pre-Capillary Drum Dryness | 32.5% |
| Post Capillary Drum Dryness | 42.8% |

Use of methods (e.g. steam showers) to pre-heat the wet sheet and the reduce the water viscosity prior to the capillary dewatering roll have resulted in higher dryness levels for the web exiting the capillary dewatering roll. Such method, along with use of smaller pores, higher vacuum levels and/or longer residence times on the capillary dewatering roll could result in dryness levels exiting the capillary dewatering roll of approximately 50%. Dryness levels as high as 52% have been achieved in the laboratory using capillary dewatering. Use of two or more capillary dewatering rolls 10 in series may present a practical means for obtaining substantially longer residence times at the high operating speeds of commercial paper machines. Each roll could have successively smaller mean flow pore diameter membranes 22 and higher capillary vacuum levels to facilitate cleaning.

The design of the membrane composite, particularly the top capillary pore surface 22, contributes to being able to keep both the capillary surface 22 and the overall membrane composite 12 clean. Membrane contamination is a major problem experienced in capillary dewatering systems. Micron size pores are easily clogged. As noted above, the current invention preferably uses capillary pores having a pore diameter in the range of 2 to 10 microns with the small pore aspect ratio (l/d) of 20 or less. In addition, the pores are essentially straight-through and non-tortuous, and the membrane has a high permeability with increasing flow area after the minimum restriction presented at the capillary membrane surface 22. Once the paper web has left the capillary dewatering roll 10, the capillary surface is intermittently exposed to external, high pressure showers 18 which clean the composite membrane during operation of the capillary dewatering roll 10. High pressure showers 18 work from the outside of the membrane composite 12 toward the center of the dewatering roll 10. The energy and momentum in the spray forces any particulates lodged in the pores through the minimum restriction (which is generally located on the outer side of the membrane composite 12), out the underside of the capillary layer 22, and through the successively larger openings of composite layers 24, 26, 28. Contaminants are thus flushed into the center of the roll with the water from the shower and the water absorbed from the paper web. Debris left on the surface of the capillary membrane is flushed off by that portion of the water shower deflected tangentially by the solid part of the capillary membrane surface 22.

In designing an adequate pressure shower 18 for cleaning purposes, with the shower 18 directed substantially radially to the capillary dewatering roll 10 such that the shower strikes the membrane surface 22 substantially at right angles, it is believed that if the water still possesses ½" hydraulic head after penetrating the composite membrane 12, the shower should be energetic enough to clean the composite membrane 12. The hydraulic head referred to is the height of the water column on the coarse side (inside of roll 10) of the composite membrane 12 when the shower water is impinged vertically upward on and perpendicularly to the fine capillary side on the membrane (outside surface of roll 10).

Different combinations of nozzle sizes, configurations, spacings, and pressures can produce the desired half-inch minimum hydraulic head. A spray manifold which has been found to work well on an experimental paper machine with a capillary dewatering roll 10 consisted of Spraying Systems Company model no. 1506 nozzles operating at 690 psig located 2.5 inches from the surface on membrane 22. This configuration penetrated a 325×2300 mesh, Double Dutch Twill composite membrane with 0.65 inch hydraulic head. The corresponding width of penetration of the composite membrane 12 was 1.5 inches. Since the spacing between adjacent nozzles was 3 inches, centerline-to-centerline, while the effective cleaning width per nozzle was only 1.5 inches, the shower was oscillated in the cross machine direction to ensure 100% coverage of the composite membrane 12. The oscillation frequency was varied with line speed to keep the maximum intermittent time that a particular area of the membrane 12 was not impinged upon by the spray to 14 seconds. This resulted in any portion of the membrane 12 being washed only 0.2% of the total time. Values as low as 0.04% have been achieved. By way of example, on the experimental paper machine which included a capillary dewatering roll 10, the spray nozzles were oscillated in the cross machine direction at a rate of 0.214 in./sec. Such experimental paper machine is operated at a line speed of 500 fpm and the capillary dewatering roll 10 on such experimental paper machine has a diameter of 2 ft.

It should be noted that different membrane designs require different showering combinations. For example, it appears that the Nuclepore 5 micron capillary surface would require pressures of only about 100 to 200 psi to maintain adequate cleanliness if used as the capillary surface layer 22 for the capillary dewatering roll 10 of the experimental paper machine discussed in the preceding paragraph.

Figure 7:
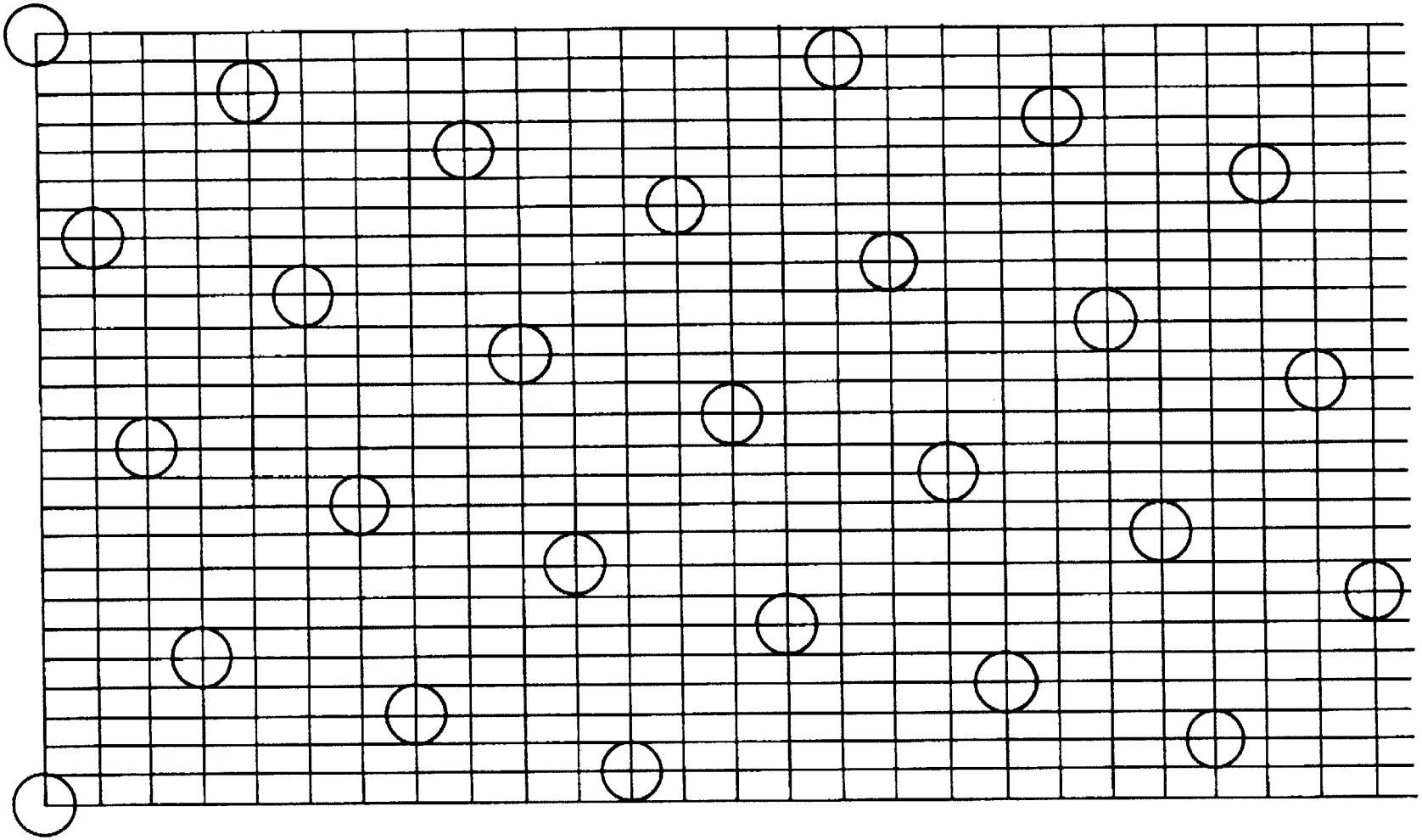
FIG. 7 is a depiction of a preferred capillary vacuum roll hole pattern according to a preferred embodiment of the invention.

The perforated vacuum cylinder 30 needs to be made of a non-corrosive material. Stainless steel is preferred although bronze can also be used. The hole size and distribution should be such as to provide uniform vacuum to all areas on the underside of the capillary membrane composite 12. For example, the vacuum roll 30 may have ⅛" diameter holes on staggered ½" centers as depicted in FIG. 7. If desired, grooves could be cut in the surface to facilitate water drainage and vacuum uniformity.

The vacuum is introduced to capillary dewatering roll 10 through a stationary center journal. There are no multiple internal chambers in capillary dewatering roll 10 being operated at different levels of pressure or vacuum. Such multiple internal chambers being operated at different pressure or vacuum levels can create significant operating problems such as leakage from chamber to chamber, wear of the cylinder journals, and unbalanced loads in the rotating cylinder. The only leakage of air into the roll of the present invention comes through the mechanical seals at the center journals and those larger pores where the effective capillary breakthrough pressure is exceeded. This air flow is relatively small and is substantially less than the air flow in a corresponding vacuum dewatering box.

Because the entire interior of the capillary dewatering cylinder 10 is maintained at a uniform vacuum level with respect to the atmosphere, the shell is subjected to the uniform pressure differential. Shell thickness is thus determined by normal stress analysis techniques. With the non-sectored vacuum roll 30, there are no major unbalanced forces, so bearing loads are minimized. The shell should be designed for about 25" $H_g$ differential (max).

As mentioned previously, water may be removed from the inside of the roll 10 by means of a siphon 20 which ends at or near the inside wall of cylinder 30. It is preferable to continuously remove water from beneath the composite membrane 12 through the vacuum drum shell 30. No continuous water film under the capillary surface membrane 22 or under the composite membrane 12 is needed. Any water film will produce increased centrifugal force at the high paper machine speeds at which the capillary dewatering roll 10 will be operated; this must be offset by a corresponding increase in the capillary vacuum. There are a number of alternate ways to remove this water including a water scoop.

The nip roll 16 is intended to establish hydraulic contact between the water in the web W and the water in the capillary pores of the membrane surface 22. Some water is pushed from the web in the area of the knuckles on the transfer fabric 14. This water fills any void volume in the capillary membrane surface 22 and reduces the interfacial resistance to water movement from the web W into the pores of the capillary membrane surface 22. In addition, the fiber network of the web W is brought into more intimate contact with the capillary surface 22 and some trapped air may be removed from the web W. These factors should aid in dewatering the web W.

The nip roll 16 should apply a very light load to the sheet which is held between the open knuckled carrier fabric 14 and the capillary membrane surface 22. The nip roll 16 should preferably have a relatively soft covering. A soft rubber cover having a P & J hardness of about 150 has been used successfully. Forces of about 10 to 45 pli have been applied by the nip roll 16 producing average values of about 11 to 38 psi in the nip between the nip roll 16 and the capillary dewatering roll 10. Values of about 20 pli (about 20 psi in the nip) or less appear to be sufficient to promote the beneficial factors mentioned above. The lower the pressure in the nip, the less chance of compressing the overall web. A very wide, soft nip is preferred allowing the paper to be lightly pressed only in the knuckle area of the transfer fabric 14 to ensure that there is no substantial overall compression of the web W. The use of the nip roll 16 increases the dryness out of the capillary dewatering drum 10 of the present invention by about 2 to 7 percentage points (e.g. Example B). This is a large amount of water and a major advantage of the system of the present invention.

Typically, the open, knuckled transfer fabric 14 is a woven, polyester fabric normally found in through dryer processes (e.g., Albany 5602 as manufactured by Albany International of Albany, N.Y.). Other types of transfer fabrics may be acceptable including metal or plastic wires, forming type fabrics, non-woven fabrics, or even certain differential wet press papermaking felts. The open, knuckled transfer fabric 14 must be permeable to air and must not substantially compress the sheet when pressed against the capillary membrane surface 22. Typically, the knuckle or press areas of the transfer fabric 14 should be less than about 35% of the surface area of the fabric 14, and most preferably, in the range of 15% to 25% of the surface area of the fabric 14.

The residence time during which the wet web W and the capillary membranes surface 22 are in contact with one another is a function of the amount of wrap around the capillary dewatering drum 10, the diameter of the capillary dewatering drum 10, and the operating speed. Residence time may be defined by the equation $$t=0.5236DA/V$$

where:

t=residence time (sec.)

D=roll diameter (ft.)

A=wrap angle in degrees

V=tangential velocity (fpm)

Wrap angles from about 200° to 315° are expected. The greater the wrap angle the more dewatering will be accomplished. Residence times of at least 0.15 seconds are desired and up to 0.35 seconds are preferred. Although the sheet will become dryer with more residence time, the rate of change is fairly slow above 0.15 seconds. One test run with a Dutch Twill composite membrane showed a decrease in dryness of only about 1% (39% down to 38%) as a residence time was reduced from 0.46 seconds to 0.24 seconds.

The capillary dewatering system of the present invention has demonstrated the ability to dewater unpressed wet webs to dryness levels approaching 43%. For premium tissue furnishes the capillary dewatering method and apparatus of the present invention has achieved dryness levels of from about 36% to about 42% dry. The dryness out of the capillary dewatering drum 10 is a function of the furnish, basis weight, refining level, membrane pore size and permeability, capillary vacuum level, nip roll, and residence time.

During the capillary dewatering step of the present invention, the density and thickness of the tissue are maintained equal to or better than that of a corresponding through dried and creped tissue web (See Product Examples 1A, 1B, 2A and 2B). No overall compression of the web took place allowing for the production of a bulky, low density web. Product Examples 1A and 2A are standard through air dried, creped Scott tissue products. Product Examples 1B and 2B are capillary dewatered, through air dried tissue products made with the process of the present invention. The furnish for Product Examples 1A and 1B was a homogeneous blend of 65% pine and 35% eucalyptus. The furnish for Product Examples 2A and 2B was a homogeneous blend of 70% NSWK and 30% eucalyptus.

PRODUCT EXAMPLES 1A AND 1B
One Ply Tissue Products

| | 1A | 1B |
|---|---|---|
| Speed (fpm) | 500 | 500 |
| Nip Roll Loading (pli) | — | 27 |
| Capillary Roll Vacuum ("$H_2O$) | — | 111 |
| Pre-Capillary Roll Dryness (%) | — | 24.9 |
| Post Cap. Roll Dryness (%) | — | 38.2 |
| Pre-Through Dryer Dryness (%) | 30.5 | 38.2 |
| Basis weight (lb./2,880 ft.$^2$) | 16.8 | 16.5 |
| Thickness (mils/24 ply @ 1.0 Kpa) | 297 | 303 |
| MDT (oz./in.) | 18.7 | 19.2 |
| CDT (oz./in.) | 9.3 | 9.1 |
| Apparent Density (gm/cc) | 0.0906 | 0.0871 |

PRODUCT EXAMPLES 2A AND 2B
One Ply Tissue Products

| | 2A | 2B |
|---|---|---|
| Speed (fpm) | 500 | 500 |
| Nip Roll Loading (pli) | — | 34 |
| Capillary Roll Vacuum ("$H_2O$) | — | 130 |
| Pre-Capillary Roll Dryness (%) | — | 30.2 |
| Post Cap. Roll Dryness (%) | — | 39 |
| Pre-Through Dryer Dryness (%) | 30.9 | 39 |
| Basis weight (lb./2,880 ft.$^2$) | 16.3 | 15.7 |
| Thickness (mils/24 ply @ 1.0 Kpa) | 274 | 290 |
| MDT (oz./in.) | 18.5 | 22.0 |
| CDT (oz./in.) | 8.4 | 11.0 |

-continued

| | | |
|---|---|---|
| Apparent Density (gm/cc) | 0.0954 | 0.0867 |

Figure 8:
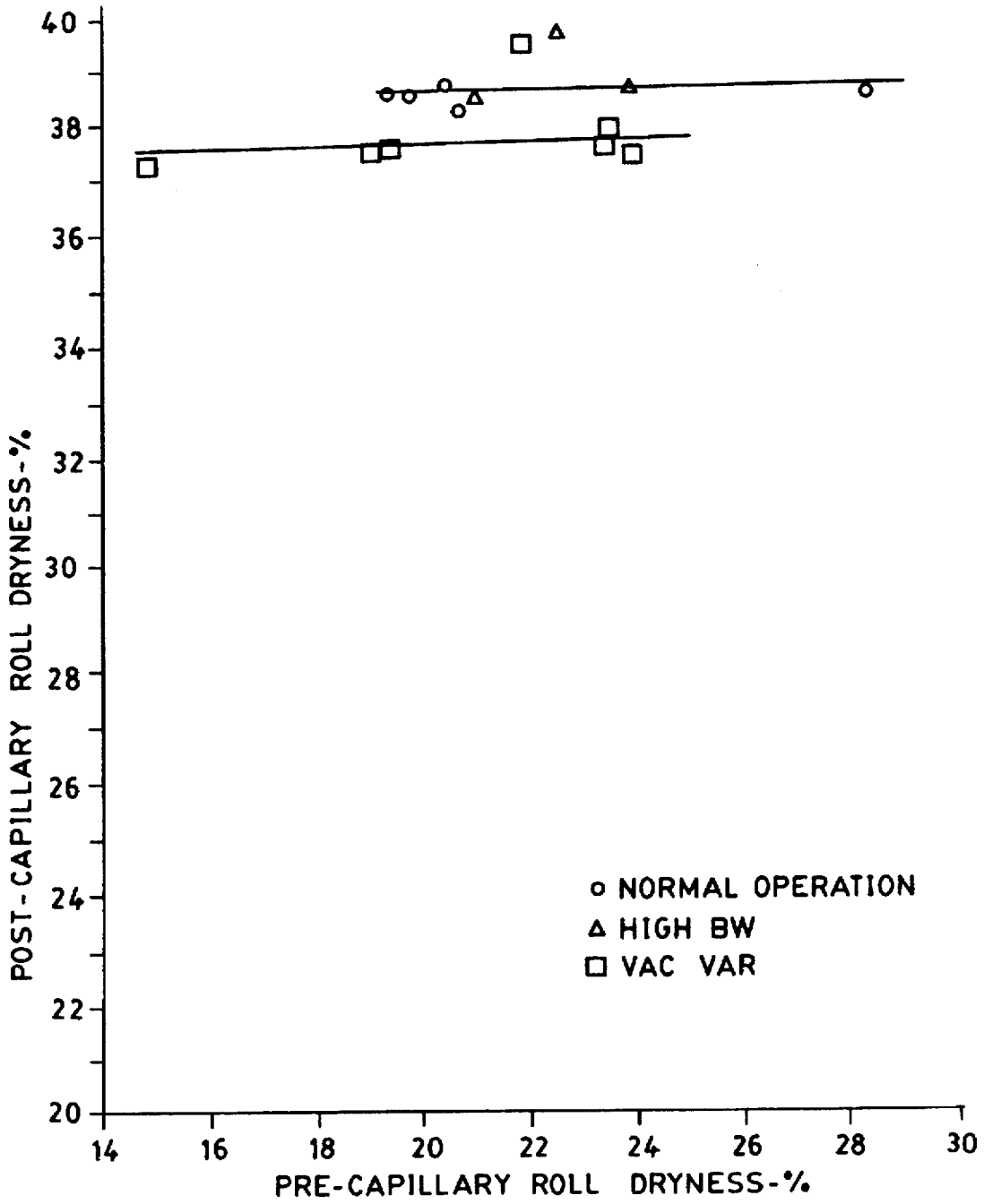
FIG. 8 is a graphical depiction of the effect of entering dryness level on the capillary dewatering roll.

Another advantage of the capillary dewatering system of the present invention is that the dryness out of the capillary dewatering drum 10 is relatively independent of the incoming dryness of the web W. For any given set of conditions, the dryness of the web W out of the capillary dewatering drum 10 does not vary by more than about 1% as the dryness of the web W in is varied from about 14% to about 30% (e.g. FIG. 8). The dryness of the web W out tends to increase slightly as the incoming dryness increases above about 30%. This has several benefits. First, by being able to remove extremely large volumes of water (e.g., 14% dryness in to 38% dryness out is equivalent to 4.51 gw removed for every gf), the number of energy intensive vacuum dewatering stations used in the overall papermaking process can be reduced or perhaps even eliminated. Secondly, the capillary dewatering system acts as a smoothing device for moisture streaks. Non uniformities in moisture going into the capillary dewatering roll 10 come out greatly reduced or flattened. If a through dryer is used in the next stage of drying, this results in better drying in the through dryer and fewer streaks on the through dryer fabric.

A further advantage of the capillary dewatering system of the present invention is its relative insensitivity to basis weight. Changes in basis weight from about 12 lbs. per ream to about 25 lbs. per ream do not seem to result in any major changes in post capillary dewatering roll dryness. One test produced less than 1 percentage point difference. This feature again tends to reduce undesirable effects associated with basis weight non uniformities and permits a range of products (from lightweight facial tissue to heavyweight towel) to be run on the same paper machine.

The capillary dewatering roll 10 can be used in combination with through dryers, Yankee dryers, gas fired surface temperature dryers, steam heated can dryers, or combinations thereof. For example, looking next at FIG. 9, there is shown a head box 50 delivering stock to a forming wire 52 forming the wet embryonic web W thereon. The web W is vacuum dewatered by means of vacuum boxes 54. The web W is then transferred to a knuckled through dryer fabric 56 when the web W is in the range of from about 10% to about 32% dry by means of a vacuum pick up 58. If desired the sheet may be further dewatered and shaped by vacuum box 59, although this box is not required. The knuckled through dryer fabric 56 carries the web W to the capillary dewatering roll 10 with the dryness of the web W being in the range of from about 12% to about 32% dry as it enters the capillary dewatering roll 10. The nip roll 16 presses the web W and the knuckled through dryer fabric 56 against the capillary membrane 12 of capillary dewatering roll 10. The dryness out of the capillary dewatering roll will be in the range of from about 33% to about 43% dry. The through dryer fabric 56 then carries the web W through a through dryer 60. The web W, at a dryness in the range of from about 65% to about 95%, is then transferred to the Yankee dryer 62 being pressed thereon by press roll 64. The web is then creped from Yankee dryer 62 when the web is at a dryness of from about 95% to about 99% dry, and run through calendar rolls 66.

Figure 9:
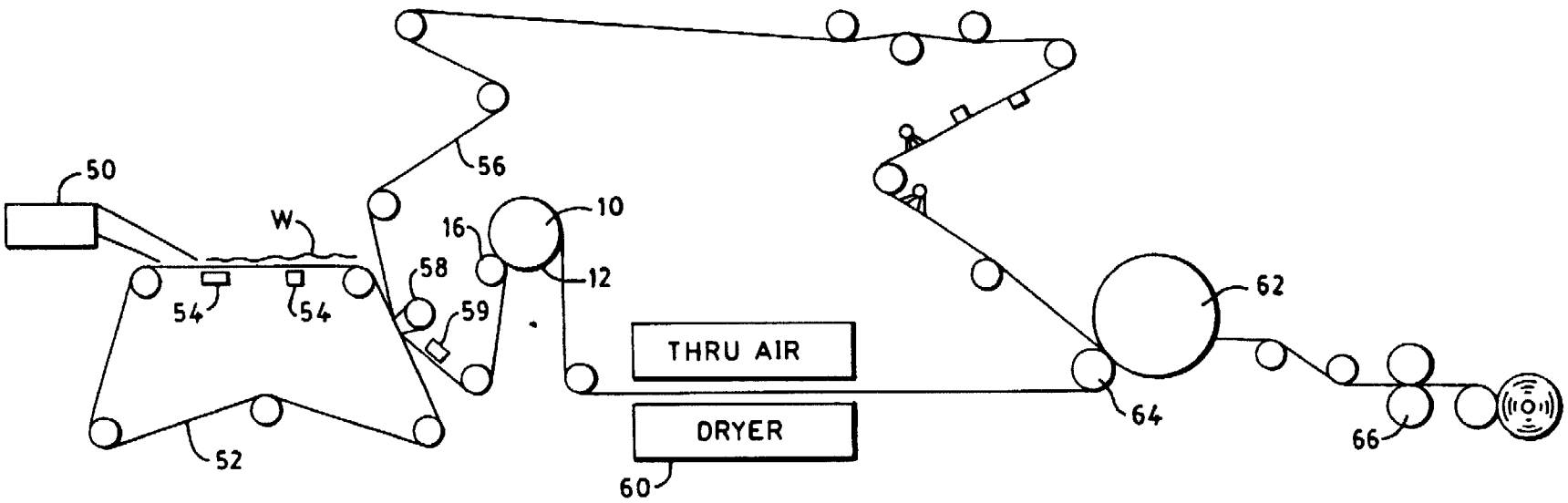
FIG. 9 is a diagrammatical depiction of a web papermaking machine according to the invention, with a capillary dewatering roll, a through air dryer, and a crepe dryer.
Figure 10:
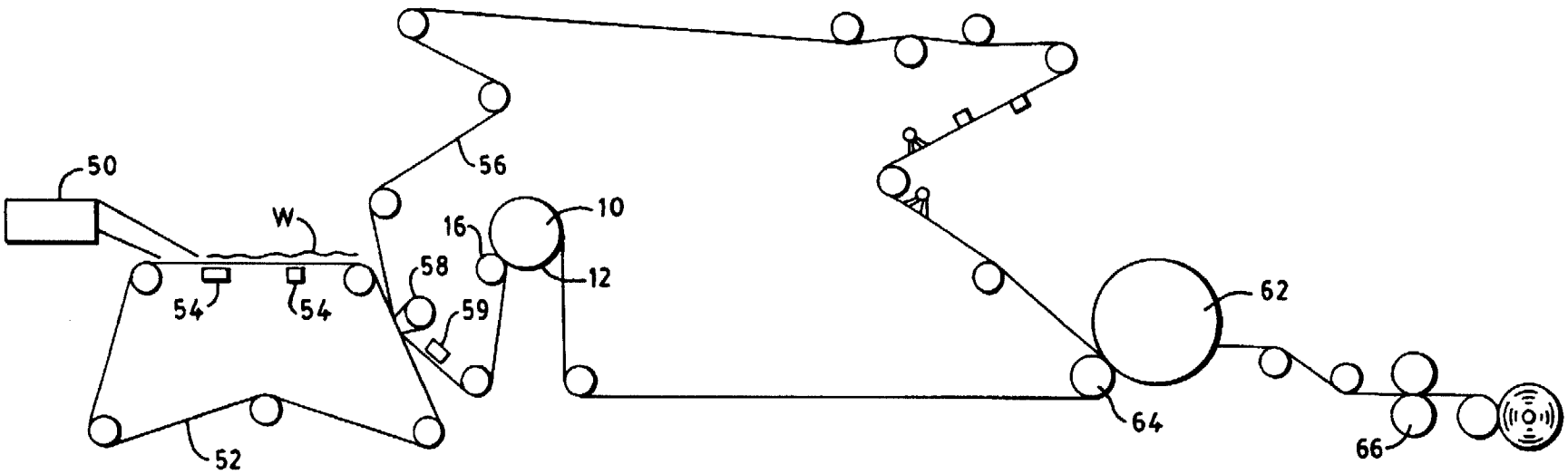
FIG. 10 is a diagrammatical depiction of a web papermaking machine according to the invention, with a capillary dewatering roll and a crepe dryer, but no through air dryer.

An alternative papermaking process utilizing the capillary dewatering drum 10 of the present invention is depicted in FIG. 10. The components used in such process are virtually identical to those shown and described in FIG. 9. Accordingly, like components in FIG. 10 are numbered as they were in FIG. 9. The only difference in the process shown in FIG. 10 is that the through dryer has been removed. Thus, with the capillary dewatering roll 10 receiving a web W at a dryness of 12% to about 32% dry with the web W exiting roll 10 at a dryness of from about 33% to about 43% dry, the web W is only in the range of from about 33% to about 43% dry as it is transferred to the Yankee dryer surface. Creping occurs at 95% to 99% dry. Tissue made with the use of the capillary dewatering roll in this manner (FIG. 10) had thickness, density, and handfeel values equal to or better than those of a comparable basis weight tissue product made with though dried and creped process and no capillary dewatering (see Product Example 3A, 3B, 4A and 4B). Product Example 3A was made with an all through dried process followed by a Yankee crepe dryer. Product Example 3B was made with the capillary dewatering process of the present invention followed by drying with a through air dryer and then a Yankee crepe dryer. Product Example 4A is a creped product and was made with the capillary dewatering process of the present invention with drying completed only on a Yankee dryer, with no through dryer. Product Example 4B is a conventional felt pressed and dry creped tissue product. The furnish used to make the Product Examples 3A, 3B, 4A and 4B was a homogeneous blend of 70% NSWK and 30% eucalyptus.

PRODUCT EXAMPLES 3A AND 3B
Two Ply Tissue Products

| | 3A | 3B |
|---|---|---|
| Speed (fpm) | 500 | 500 |
| Capillary Roll Vacuum ("$H_2O$) | — | 115 |
| Pre-Capillary Roll Dryness (%) | — | 32 |
| Post Cap. Roll Dryness (%) | — | 39.7 |
| Pre-Crepe Dryer Dryness (%) | 35.7 | 39.7 |
| Two Ply Properties | | |
| Basis Weight (lb./2,880 ft.$^2$) | 20.9 | 22.2 |
| Thickness (mils/24 ply @ 1.0 Kpa) | 463 | 516 |
| MDT (oz./in.) | 12.3 | 12.2 |
| CDT (oz./in.) | 5.7 | 5.6 |
| Apparent Density (gm/cc) | 0.0725 | 0.0691 |
| Finished Product Handfeel* | 1.00 | 1.04 |

PRODUCT EXAMPLES 4A AND 4B
Two Ply Tissue Products

| | 4A | 4B |
|---|---|---|
| Speed (fpm) | 500 | 500 |
| Capillary Roll Vacuum ("$H_2O$) | — | 115 |
| Pre-Capillary Roll Dryness (%) | 27.3 | — |
| Post Cap. Roll Dryness (%) | 39.8 | — |
| Pre-Through Dryer Dryness (%) | 39.8 | 26.2 |
| Two Ply Properties | | |
| Basis Weight (lb./2,880 ft.$^2$) | 21.8 | 20.6 |
| Thickness (mils/24 ply @ 1.0 Kpa) | 489 | 343 |
| MDT (oz./in.) | 9.8 | 10.7 |
| CDT (oz./in.) | 4.4 | 4.1 |
| Apparent Density (gm/cc) | 0.0716 | 0.0966 |
| Finished Product Handfeel* | 1.01 | 0.91 |

*Normalized to all through dried equal to 1.00.

The ability of the capillary dewatering system to remove water without substantial compression of the web makes it economically advantageous to retrofit a conventional wet pressed paper machine to one that can produce low density, absorbent soft tissue and towel products. For example, the wet press felt run can be replaced by a knuckled through dryer fabric and the capillary dewatering system of the present invention, inserted in the space left between the forming fabric and the Yanke crepe dryer, as shown in FIG.

Figure 12:
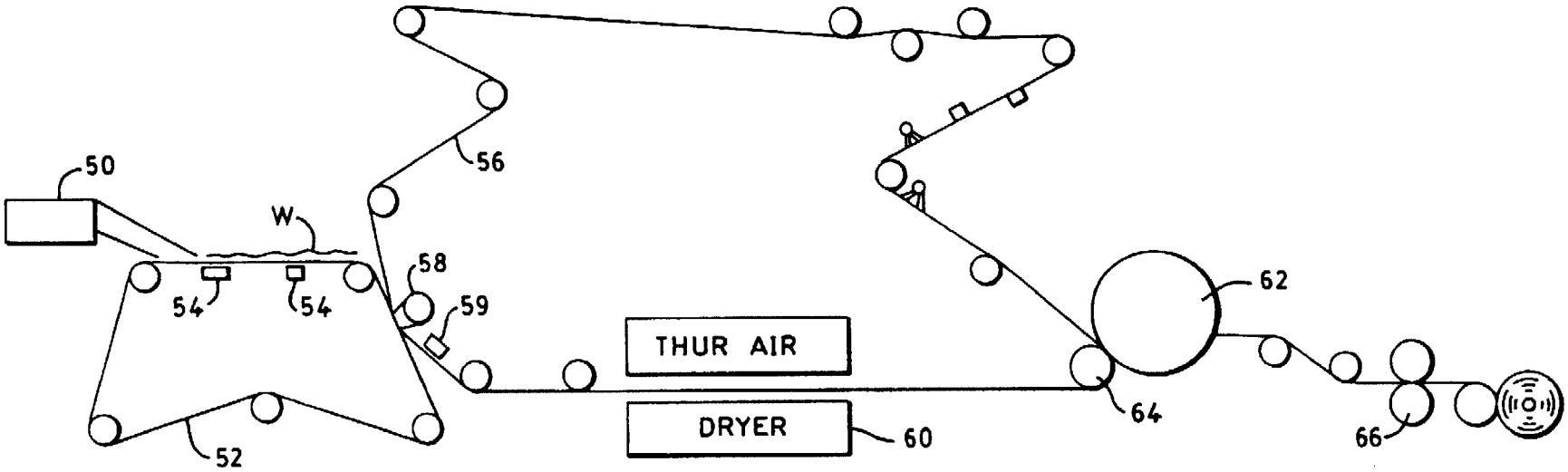
FIG. 12 is a diagrammatical depiction of a conventional web paper making machine with a through air dryer and a crepe dryer.

10. The sheet can then be transferred to the Yankee dryer at about 33% to 43% dry and creped at the paper machine's normal crepe dryness. As shown in Examples 3A, 3B, 4A and 4B above, the resulting low density soft product is very similar to the one made with a through dryer- Yankee dryer combination, as shown in FIG. 12. The cost of the retrofit using the capillary dewatering system, however, is lower and can be accomplished with less disruption to the paper machine operation. The resulting paper machine process will also use less energy than the through dryer retrofit.

Figure 11:
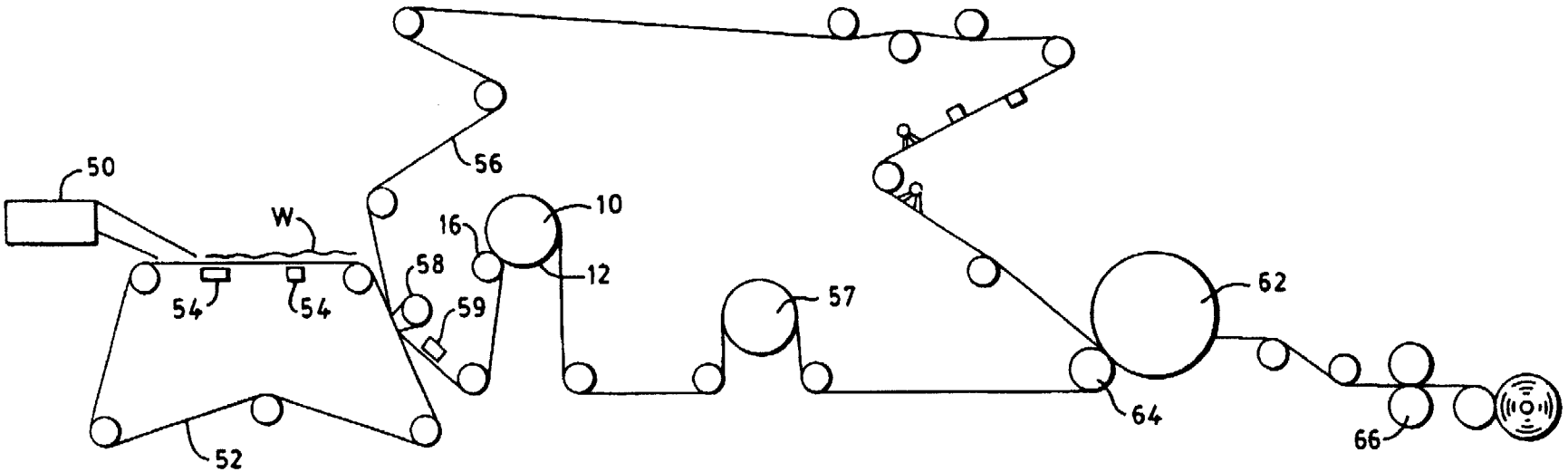
FIG. 11 is a diagrammatical depiction of a web papermaking machine according to the invention, with a capillary dewatering roll, a high temperature surface dryer and a crepe dryer.

Similarly, the capillary dewatering system can be used in combination with a through dryer to retrofit a wet press papermachine if more drying before the Yankee is desired. It can slo be used to replace one through dryer in an existing two dryer system to save energy and reduce operating costs. It will be recognized by those skilled in the art of papermaking that, although the present invention is discussed in combination with creping as shown in FIGS. 9, 10 and 11, the present invention can also be used in papermaking processes which do not include a creping step. The present invention can be used with final drying after capillary dewatering being performed with through dryers, can dryers, high surface temperature dryers, or combinations thereof with no creping step.

On existing paper machines, capillary dewatering drum 10 of the present invention can be used to reduce operating and energy costs by elimination of vacuum pumps, reduction of through dryer fan power, and less hood gas usage. Potentially, one through dryer can be eliminated from existing two through dryer processes. Keeping both through dryers in place, the capillary dewatering drum 10 of the present invention can also be used to increase the speed and productivity of a papermaking machine. By adding the capillary dewatering drum 10 of the present invention to the conventional through dryer process depicted in FIG. 12, total energy usage of the process would be reduced by 17% to 25%. From the foregoing, it should be recognized that this invention is one well adapted to attain all of the ends and objects herein above set forth together with other advantages which are apparent and which are inherent to the apparatus and method.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A system for removing water from a wet paper web during a paper web manufacturing process, comprising:

a rotating capillary dewatering roll that has a capillary membrane with capillary pores therethrough which have a substantially straight through, non-tortuous path, the capillary pores having a pore aspect ratio of from about 2 to about 20; and means for lightly pressing a web to the capillary membrane to ensure hydraulic contact between the water contained in the web and the water in the pores of the capillary membrane without overall compaction of the web.

2. A system according to claim 1, wherein said pressing means is constructed and arranged to press the web against the membrane at a lineal force that is substantially within the range of less than one to 150 pli.

3. A system according to claim 2, wherein said pressing means is constructed and arranged to press the web against membrane at a lineal force that is substantially within the range of 20–50 pli.

4. A system according to claim 1, wherein said dewatering roll is nonsectored.

5. A system according to claim 4, further comprising means for spraying the capillary membrane with a cleansing fluid to wash the surface of the capillary membrane and to flush any particulates trapped within the capillary pores through the capillary pore to the inside of the rotating capillary dewatering roll.

6. A system according to claim 5, wherein said spraying means is constructed and arranged to spray water at a pressure of from about 100 psi to about 900 psi.

7. A system for reducing the moisture content of a paper web in a papermaking process, comprising:

a rotating capillary dewatering roll that has a capillary membrane with capillary pores therethrough which have a substantially straight through, non-tortuous path, the capillary pores having a pore aspect ratio of from about 2 to about 20;

means for pressing a web to the capillary membrane to ensure hydraulic contact between the water contained in the web and the water in the pores of the capillary membrane; and means for spraying the capillary membrane with a cleansing fluid to wash the surface of the capillary membrane and to flush any particulates trapped within the capillary pores through the substantially straight through, non-tortuous capillary pores to the inside of the rotating capillary dewatering roll.

8. A system according to claim 7, wherein said spraying means is adapted to spray said cleansing fluid at a pressure of from about 100 psi to about 900 psi.

* * * * *